US005772211A

United States Patent [19]

Nazaryan et al.

[11] Patent Number: 5,772,211

[45] Date of Patent: Jun. 30, 1998

[54] WAGERING GAME

[75] Inventors: Anahit Nazaryan, Los Angeles, Calif.; Vahan Alexanian, 8440 Westcliff Dr., #1126, Las Vegas, Nev. 89102

[73] Assignee: Vahan Alexanian, Las Vegas, Nev.

[21] Appl. No.: 754,757

[22] Filed: Nov. 21, 1996

Related U.S. Application Data

[63] Continuation-in-part of Ser. No. 682,994, Jul. 18, 1996.

[51] Int. Cl.[6] ..... A63F 1/00

[52] U.S. Cl. ..... 273/292

[58] Field of Search ..... 273/292, 303, 273/304, 305, 306, 274

[56] References Cited

U.S. PATENT DOCUMENTS

| | | | |
|---|---|---|---|
| 4,651,997 | 3/1987 | Wood . | |
| 4,807,884 | 2/1989 | Breeding . | |
| 5,067,724 | 11/1991 | Rinkavage | 273/292 |
| 5,072,946 | 12/1991 | Miller | 273/292 |
| 5,118,114 | 6/1992 | Tucci | 273/292 X |
| 5,125,677 | 6/1992 | Ogilvie et al. . | |
| 5,154,429 | 10/1992 | LeVasseur . | |
| 5,257,789 | 11/1993 | LeVasseur . | |
| 5,280,915 | 1/1994 | Groussman . | |
| 5,282,637 | 2/1994 | McCreadie . | |
| 5,288,081 | 2/1994 | Breeding . | |
| 5,288,082 | 2/1994 | Marquez . | |
| 5,314,193 | 5/1994 | Ferrer . | |
| 5,314,194 | 5/1994 | Wolf . | |
| 5,322,295 | 6/1994 | Cabot et al. . | |
| 5,366,228 | 11/1994 | Kangsanaraks . | |
| 5,380,012 | 1/1995 | Jones et al. . | |
| 5,390,934 | 2/1995 | Grassa . | |
| 5,397,128 | 3/1995 | Hesse et al. . | |
| 5,413,353 | 5/1995 | Demarest et al. . | |
| 5,417,430 | 5/1995 | Breeding . | |
| 5,452,899 | 9/1995 | Skratulia et al. . | |
| 5,486,005 | 1/1996 | Neal . | |
| 5,503,401 | 4/1996 | Nguyen | 273/292 X |
| 5,549,300 | 8/1996 | Sardarian | 273/292 |
| 5,560,613 | 10/1996 | Nguyen | 273/292 |
| 5,580,061 | 12/1996 | Kong | 273/292 |
| 5,613,682 | 3/1997 | Otuzbiryan | 273/292 |
| 5,615,888 | 4/1997 | Lofink et al. | 273/292 |

FOREIGN PATENT DOCUMENTS

| | | | |
|---|---|---|---|
| 9419074 | 9/1994 | WIPO | 273/292 |

OTHER PUBLICATIONS

Scarne's *Encyclopedia of Games,* "Basic Draw Poker Rules" pp. 14–32, published by Harper & Row, New York, 1973.

*Primary Examiner*—William E. Stoll

*Attorney, Agent, or Firm*—Antonelli, Terry, Stout & Kraus, LLP

[57] ABSTRACT

A wagering card game permitting players to play against a dealer or the "house" and not against other players. Six standard decks of playing cards, from which all kings and queens have been removed, are combined. Each of the numbered cards has a number value equal to its number, jacks have a number value of zero, and aces have a number value of 11. Each player places a wager as to whether a three-card game hand to be dealt to him or her will be odd or even. If a player is dealt a jack, the player loses the wager. If a player is not dealt a jack, and the player's odd/even wager matches the sum of the number values of the three cards in that player's game hand, then the player wins the wager. Preferably, a single card is dealt face down to the dealer and in addition to an odd/even wager as to the player's own game hand, the player is permitted to place one or more other wagers as to a characteristic of the face down card. Further, each player is permitted to place additional wagers as to another characteristic of the cards in the player's own game hand. Variations of the type of game hand dealt are also possible.

31 Claims, 5 Drawing Sheets

WAGERING GAME

CROSS-REFERENCE TO RELATED APPLICATION

This application is a continuation-in-part of U.S. patent application Ser. No. 08/682,994, filed Jul. 18, 1996, pending.

FIELD OF THE INVENTION

The present invention pertains to a wagering game. More particularly, the present invention pertains to a method by which a number of players play a wagering card game, with each player placing a wager identifying a type of game hand and then being dealt a game hand consisting of three cards. Each player whose wager identifies the type of game hand dealt to that player wins his or her wager, while all other players lose their wagers. Preferably, one additional card is dealt face down, and all the players have the option of placing additional wagers on that card.

BACKGROUND OF THE INVENTION

Numerous types of wagering card games are played, both for financial gain and for entertainment. Successful wagering card games offer fast play, the need for the players to make decisions, multiple opportunities for placing wagers, and rapid determination of a winner. Such games require both skill and an element of luck.

While poker type card games are popular with many people, other people, particularly amateur players, prefer games in which they compete against only a dealer or "the house," rather than competing against other players. Games offering multiple wagering opportunities are particularly popular. Likewise, wagering card games which rapidly determine a winner have greater popularity. While the level of skill involved affects the popularity of wagering card games, among amateur players other factors are likewise important, including the opportunity for each player to make decisions affecting his or her outcome in the game.

SUMMARY OF THE INVENTION

The present invention is a wagering card game in which each player competes only against a dealer or "the house," and yet each player is called on to make one or more decisions in each hand of the game, so that the card game appeals to many players, particularly amateur players such as tourists visiting a gambling casino for a brief period of time.

The game is played with a deck of game cards formed by combining a plurality of standard decks of playing cards. In one embodiment of the game, all face cards have been removed from the deck of game cards, leaving only numbered cards and aces, with the numbered cards having a number value equal to their number, and with the aces having a number value of eleven. Each player places a wager identifying a type of game hand, and then each player is dealt face up a game hand of three cards. If the player's wager identifies a game hand of the type dealt to that player, then the player wins the wager. Otherwise, the player loses the wager.

The types of game hand on which a player might wager include "odd/even" in which the wager identifies whether the total number value of the three cards making up the game hand is an odd number or even number. Another type of game hand is "red/black" in which the wager identifies the color of at least two of the three cards dealt to the player. Similarly, the wager can identify a game hand having at least one card of a number specified by the wager, at least one card of a suit specified by the wager, or at least one card specifically identified by both number and suit. The wager could be that the three cards have the same number. Similarly, the wager could identify the numbers of all three cards of the game hand, and those three cards might be three cards of three different numbers or three cards of the same number. The wager could identify the three suits of the three cards or could be that the three cards are all of the same suit, either identifying the suit or not identifying the suit. Various other types of game hands might also be identified by a wager.

Each player places a wager identifying a type of game hand, and then each player is dealt face up a game hand of three cards. If a player's wager identifies a game hand of the type dealt to that player, then the player wins the wager. Otherwise, the player loses the wager.

In one preferred embodiment of the invention, the dealer is dealt a single card face down, and each player is offered the opportunity to place an additional wager as to a characteristic of that face down card. By way of examples, the characteristic might be whether the card is odd or even, whether the card is red or black, the numerical value of the card, the suit of the card, or the specific identity (i.e. both suit and number) of the card.

In another preferred embodiment of the invention, all the kings and queens are removed from the deck of game cards, leaving the numbered cards, aces, and jacks, with the numbered cards having a number value equal to their number, the aces having a number value of eleven, and the jacks having a number value of zero. The same types of wagers are available to the players in this embodiment of the wagering game as are available in the above-described embodiments of the game in which all face cards are removed from the deck of game cards. However, in this embodiment, any player who is dealt a single jack loses his or her wager, but any player who is dealt two or more jacks, wins a multiple of his or her wager. Further, if a player has placed a wager on a characteristic of the dealer's card and the dealer is dealt a jack, then if the jack matches the characteristic, the wager is a "push" and the amount of the wager is returned to the player, but if the dealer's jack does not match the characteristic, then the player loses the wager.

The wagering game can be played at a casino style wagering table, at a card table, or at any other convenient facility. Further, the wagering game can be implemented on an electronic gaming table, permitting each player to play by himself or herself by inserting coins or tokens to activate the electronic gaming table.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings.

Each of FIG. 3

DETAILED DESCRIPTION OF PREFERRED EMBODIMENTS

Figure 1:
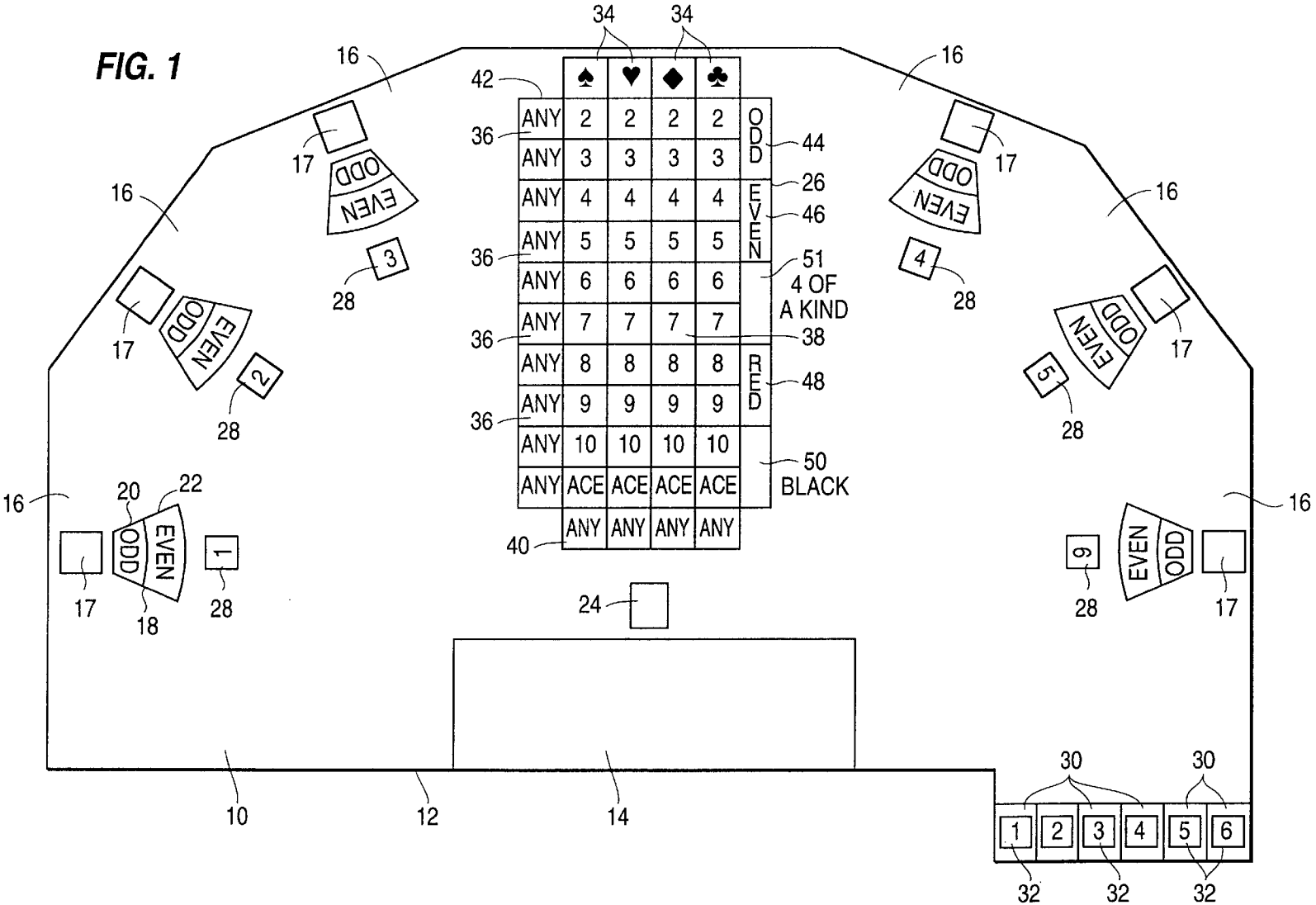
FIG. 1 is a plan view of a first embodiment of a wagering table useable in playing a wagering game in accordance with the present invention.

The wagering game of the present invention is played with a deck of game cards made up of a plurality of decks of standard playing cards, for example six decks. In a first embodiment of the wagering game, all face cards have been removed from the deck of game cards, leaving only the numbered cards 2–10 and the aces. Each numbered card has a number value corresponding with the number on the card, while each ace has a number value of 11. As is well known, each standard deck of playing cards includes four suits, namely spades, hearts, diamonds, and clubs. The deck of game cards thus includes forty cards from each standard deck, and since six standard decks are preferably used, the deck of game cards has a total of two hundred forty cards.

In its simplest form, the wagering game might be referred to as "odd/even". In this form of the game, each player is dealt face up a game hand of three cards. The total number value of the three cards determines whether the game hand is odd or even. Thus, if a player places a wager on odd, and the number values of the three cards of that player's game hand add up to an odd number, then that player wins the wager, but if the cards of the player's game hand add up to an even number, then the player loses. Conversely, if the player places a wager on even, and the number values of the three cards of that player's hand add up to an even number, then that player wins, but if those three cards add up to an odd number, the player loses. The amount that each winning player wins depends upon the amount of the wager placed by such player and the odds given on winning, as determined by the proprietor of the game or the "house."

In a preferred form of the game, in addition to each player being dealt a game hand of three cards, the dealer is dealt a single card, face down. Each player then places a first wager as to whether that player's game hand is odd or even, and each player is given the opportunity to place a second wager as to a specific characteristic of the dealer's card. Preferably, in this form of game two cards are dealt face up to each player, a single card is dealt face down to the dealer, and then a third card is dealt face up to each player. As each player receives his or her third card, it is immediately determined whether that player has won the odd/even wager of that player. After each player has a third card so that all of the odd/even wagers are determined, the dealer turns over his or her game card, and all of the wagers as to a characteristic of the dealer's card are determined. Those player's who have placed a second wager on a characteristic that is found in the dealer's card win their second wager, while those players who have placed a second wager on a characteristic not found in the dealer's card lose.

The characteristic of the dealer's card might be any one or more of several possible characteristics. By way of example, the wager could be that the dealer's card has an odd number value or that it has an even number value. Alternatively, the wager could be that the dealer's card is red or that the dealer's card is black. Similarly, the wager could be that the dealer's card is of a specified number. Likewise, the wager could be that the dealer's card is of a specified suit. In addition, the wager could be that the dealer's card is a specific card. Different players might place different types of these wagers, and any one player might place wagers on more than one characteristic. Thus, a first player, in addition to placing an odd/even wager as to his or her own game hand, might place a wager that the dealer's card is of a particular number, such as a seven. Another player might place an odd/even wager as to his or her own game hand and might also place a wager that the dealer's card is a diamond. Still another player could place an odd/even wager on his or her own game hand, an odd/even wager on the dealer's card, and a wager that the dealer's card is red. Thus, each player is wagering only as to his own hand being odd or even and as to one or more characteristics of the dealer's card; the players are not competing against each other.

It is preferred that each player be required to place an odd/even wager as to his or her own hand before such player is allowed to place a wager as to a characteristic of the dealer's card so as to reduce the effectiveness of card counting. In addition, it is preferred that the second wager as to a characteristic of the dealer's card not be compulsory, so that the game will have greater appeal to novice players.

FIG. 1 depicts a first embodiment of a gaming table 10 useable in playing a wagering game in accordance with the present invention. Gaming table 10 includes a dealer side 12 which has an area 14 for a non-playing dealer, and a player side with locations 16 for a plurality of players, illustratively depicted in FIG. 1 as six player locations, numbered one through six. At each player location there is a card area 17 for placement of the player's game cards, together with a wagering area 18 which includes a first wagering location 20 for placing a wager on an odd game hand and a second wagering location 22 for placing a wager on an even game hand. Thus, each player is able to place an odd/even wager that his or her game hand will be an odd game hand or an even game hand.

Adjacent dealer area 14 is a dealer card area 24 on which a non-playing dealer can place a face down card for each deal of the wagering game. A dealer card wagering area 26 is centrally located on table 10 so that each of the players at the several player locations 16 is able to place a wager on the dealer card, for example by placing a wagering token or chip on a space on the dealer card wagering area. In front of each of the player wagering areas 18, is a unique identifying indicium 28. FIG. 1 illustrates each of these indicium containing a different number. Preferably, the indicium 28 for each player location 16 has a unique color applied to it. A wagering token supply area 30 is provided adjacent dealer area 14 for each of the player locations 16, and each wagering token supply area 30 is identified by an indicium corresponding with the indicium 28 of the associated player area. Thus, each wagering token supply area 30 has on it an indicium such as a number of the same color as the indicium 28 adjacent the associated player area. A supply of wagering tokens, such as chips, is kept in each wagering token supply area 30. The tokens within each area 30 are preferably colored the same color as the associated indicia 28 and 32. If desired, a glass or other cover can be provided to permit access to the wagering token supply area 30 only from the dealer's side 12 of gaming table 10. When a player commences playing at one of the wagering areas 18, the player purchases from the dealer a supply of the wagering tokens or chips of the color associated with the wagering area of that player, as indicated by the indicium 28 of that wagering area. Thus, the wagering tokens placed by each player on the dealer card wagering area 26 can be identified by the associated color.

The dealer card wagering area 26 includes a wagering space for each of various wagers that players might make as to the card dealt at location 24 for the dealer. Thus, FIG. 1 depicts dealer card wagering area 26 as an array of squares, with a column 34 for each of the four card suits, spades, hearts, diamonds, and clubs, and a row 36 for each of the game card numbers 2 through 10 and ace. To place a wager on a specific card, a player places a chip in the square defined by the suit column and number row of that card. For example, if a player wants to wager that the dealer's card is the seven of diamonds, the player places a chip of the color associated with that player's location 16 within square 38 which is in the diamond column and which bears numeral 7 within it. In addition, dealer card wagering area 26 includes a row 40 having an ANY square for each of the four suits, and a column 42 having an ANY square for each of the numbers 2–10 and ace. A player wishing to place a wager that the dealer's card is a card of a particular suit, without specifying the number of that card places a chip on the square within row 40 for the column of that suit. Likewise, a player wishing to place a wager that the dealer's card is a particular number, without specifying the suit, places a chip in the ANY square of column 42 corresponding to the desired number.

Wagering area 26 also includes a space 44 for placement of chips to wager that a dealer's card is an odd number, a space 46 for placement of chips to wager that the dealer's card is an even number, a space 48 for placement of chips wagering that the dealer's card is red, and a space 50 for placement of chips wagering that the dealer's card is black. Thus, dealer card wagering area 26 has a space for placement of chips to indicate wagers as to each of the characteristics of the dealer's card dealt face down at dealer card area 24.

In playing this form of the wagering game, then, each player at a player area 16 places a chip of the color corresponding with that player area on either the odd wager location 20 or the even wager location 22 of the associated wagering area 18. If the game includes a dealer card 24, then each player is provided the opportunity to place one or more additional wagers by placing one or more chips on the spaces of the dealer card wagering area 26 that correspond with the desired wagers. The dealer at dealer area 14 then deals three cards face up to each player, or if a dealer card is to be utilized then instead deals two cards face up to each player, a card face down to dealer card area 24, and a third card face up to each player. As the third card is dealt to each player, the odd/even wager of such player is immediately determined, and the dealer pays winning wagers and collects losing wagers. If a dealer card is included, then after each player has three face up cards, the dealer turns the card at dealer card area 24 face up so that the winners of wagers on wagering area 26 can be determined. The dealer then pays any winning wagers on that card and collects all losing wagers.

The odds paid for winning wagers are determined by the probability of a wager being a winning wager and the percentage to be retained by the wagering establishment or house.

If any player has three cards of the same number, then before turning the face down card at dealer card area 24 face up, the dealer can announce that such player may win a jackpot prize given to a player where the dealer's card is of the same number so that the player's three cards and the dealer's card form four of a kind, i.e. four cards of the same number. This adds an extra element of excitement to the game. When the dealer's card is then turned face up, it can be determined whether such player is a jackpot prize winner. If desired, wagering area 26 can include a space 51 for a player to place a wager on such a four of a kind game hand so that a player must have placed such a wager in order to be eligible for the jackpot prize. In addition, if desired separate wagers can be allowed as to (1) four of a kind with each card of a different suit, (2) four of a kind with each card of the same suit, and (3) four of a kind unrestricted as to the suits of the card.

Figure 2:
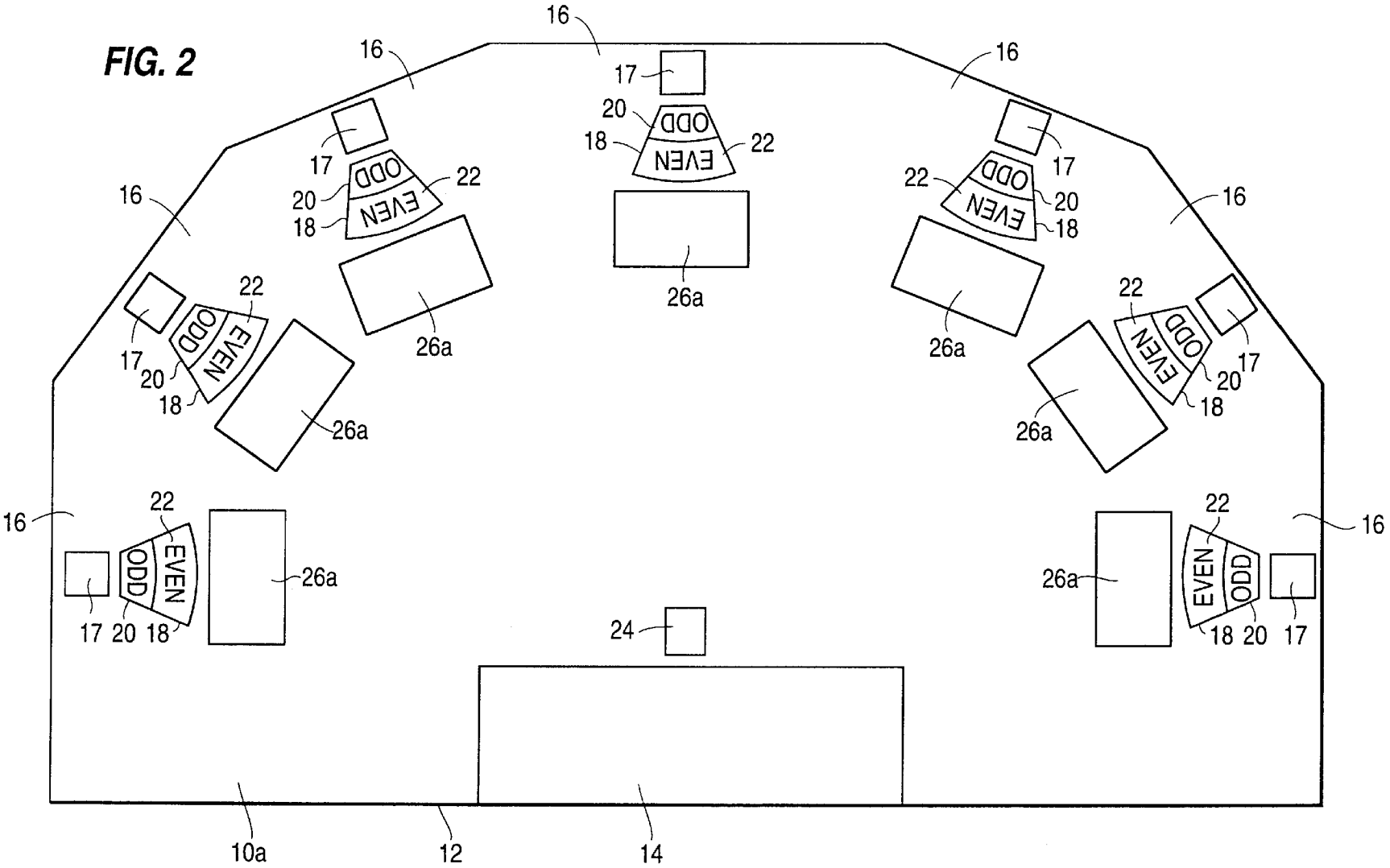
FIG. 2 is a plan view of a second embodiment of a wagering table useable in playing a wagering game in accordance with the present invention.

FIG. 2 depicts a second embodiment of a gaming table 10*a* in which, rather than a single dealer card wagering area 26 in the center of the table, a reduced scale replica of such a dealer card wagering area 26*a* is provided adjacent the wagering area 18 of each player location 16. This makes it more convenient for each player to place the chip or chips indicating wagers on the dealer's card. In addition, it permits seven player locations 16 to be provided at the gaming table, rather than six. Because each player's wager is indicated on an associated dealer card wagering area 26*a*, all of the chips can be the same color, and there is no necessity for indicia 28 and 32.

The wagering game of the present invention can also permit each player to place additional wagers as to that player's own game hand. There are several possible additional wagers which might be made on the player's own cards. These include (1) that two of the three cards are a specific color (i.e. red or black), (2) that at least one card is a particular number (e.g., a nine), (3) that at least one card is a particular suit (e.g., a club), (4) that the players three cards include a specific card (e.g., a nine of clubs), (5) that the three cards are the same number (e.g. three nines, but the player does not specify the number, only that the three cards are the same number), (6) that the three cards are the same specific number (e.g., three nines, with the player specifying the number), (7) that the three cards are the same suit (e.g., three clubs, but the player does not specify the suit, only that the three cards are the same suit), (8) that the three cards are the same specific suit (e.g., three clubs, with the player specifying the suit), (9) that the three cards are three specific numbers (e.g., a four, a seven, and a nine), (10) that the three cards are three specific suits (e.g. a spade, a heart, and a club), (11) that the three cards are three specific cards (e.g., a four of clubs, a seven of hearts, and a nine of spades), (12) that the three cards are three identical cards (e.g., three nines of clubs, but the player does not specify the number or suit, only that all three cards are the same card), (13) that the three cards are three specific identical cards (e.g., three nines of clubs, with the player specifying both the number and the suit), and (14) that the number values of the three game cards add up to at least a specified number, such as 21. Other possible wagers may also be provided. The amount paid for any winning wager is determined by the probability of a player having such winning wager and the percentage of the wagered money to be kept by the house.

Figure 3:
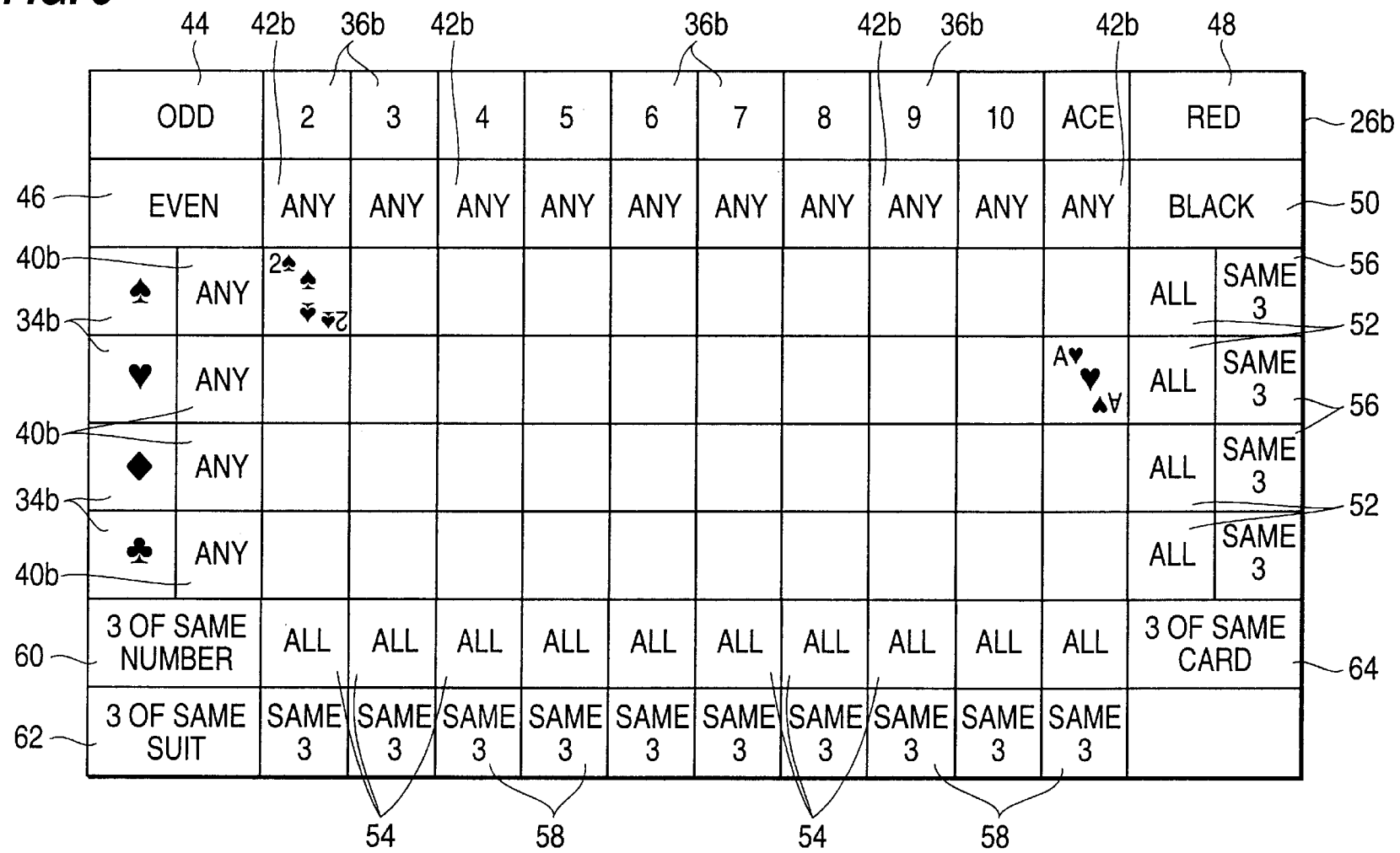

FIG. 3 depicts a wagering area 26*b* which permits a player to indicate any one of the above described wagers as to the player's own cards. Such a wagering area 26*b* might be provided at each wagering area 26*a* in the wagering table of FIG. 2, for example, The wagering area 26*b* includes a row 34*b* of squares for each of the suits spades, hearts, diamonds, and clubs and a column 36*b* for each of the number values 2 through 10 and ace. The squares defined by the intersecting rows and columns thus correspond to the various cards of the game deck and provide areas for the player to place chips to wager on those cards. If desired, each of these squares can be marked with indicia of the associated card, as indicated in FIG. 3 for the 2 of spades and the ace of hearts. Each suit row 34*b* includes a square 40*b* designated ANY to permit a player to place a wager that his three game cards will include one card of unspecified number from the associated suit. Likewise, each number column 36*b* includes a square 42*b* labeled ANY to permit a player to place a wager that one of his three game cards will be a card of the associated number, without specifying a particular suit.

Wagering area 26*b* also includes a wagering space 44 to permit a player to wager that the number value of the three game cards of that player's game hand add up to an odd number and a wagering space 46 for a wager that the cards add up to an even number. Likewise, the wagering area 26*a* includes a space 48 to permit placement of a wager that at least two of the three game cards in the player's hand are red and a wagering space 50 to permit placement of a wager that at least two of the three cards are black.

Each suit row 34*b* includes a square 52 designated ALL to permit the player to place a wager that all three game cards in his game hand will be of the associated suit, without specifying the numbers of those cards. Thus, by placing a wager in the ALL square 52 of the diamond row, for example, the player would be wagering that all three game cards to be dealt to that player will be diamonds.

Each column 36*b* associated with the number values additionally includes a square 54 designated ALL to permit a player to place a wager that all three game cards of the game hand to be dealt to him or her are of the same number, without specifying the suits of those three cards. Thus, for example, to place a wager that all three cards to be dealt to him are sevens, the player places a chip in the ALL square of the column 36*b* associated with the number 7.

Each suit row 34*b* includes a further square 56 labeled SAME 3 to permit a player to place a chip indicating a wager that the three game cards to be dealt to him or her are all of the same number value of the associated suit, without specifying the number value. Thus, by placing a chip in the SAME 3 square of the diamond row, for example, a player wagers that the three game cards to be dealt to him or her are all diamonds having the same number, without specifying the number. Similarly, each number column 36*b* includes a square 58 labeled SAME 3 to permit a player to place a wager that all three cards to be dealt to him or her will be of that number and of the same suit without specifying the suit. Thus, by placing a chip in the SAME 3 square of the 5 column, for example, a player can wager that all three game cards to be dealt to him or her will be 5's and will be of the same suit, without specifying the particular suit.

Wagering area 26*b* further includes a wagering space 60 designated 3 OF SAME NUMBER to permit a player to place a wager that the three cards to be dealt to him or her are of the same number, whether of the same or different suits, without specifying the particular number. Likewise, wagering area 26*b* has a wagering location 62 designated 3 OF SAME SUIT to permit a player to place a wager that the three cards to be dealt to him or her are of the same suit, whether of the same or different numbers, without specifying the particular suit. A wagering location 64 is also provided, designated 3 OF SAME CARD, to permit a player to place a wager that the three game cards to be dealt to him or her are identical cards, that is of the same suit and the same number, without specifying either the suit or the number.

To place a wager that the three game cards to be dealt to a player are three specific numbers, e.g., a four, a seven, and a nine, the player places a chip in each of the three number squares 36*b* associated with the desired numbers. Likewise, to indicate a wager that the three game cards are of three specific suits, e.g. a spade, a heart, and a club, the player places a chip in each of the three suit squares 34*b* for the spade, the heart, and the club suits. To place a wager that the three cards are three specific cards, e.g. a four of spades, a seven of hearts, and a nine of clubs, a player places a chip in the squares defined by the intersections of the columns and rows associated with the respective numbers and suits. To indicate a wager that the three cards to be dealt to the player are three of the same specific card, the player places three chips in the one square associated with the desired specific card. Thus, wagering area 26*b* permits a player to indicate any desired wager as to a characteristic of that player's game hand. Each player may place a wager on any of these characteristics or separate wagers on two or more characteristics If desired, each player can be provided with chips of two colors so that the player may use a chip of one color to indicate a wager as to the dealer card dealt face down at dealer card area 24 and chips of another color to indicate wagers on the three cards of the player's own game hand.

Rather than dealing three faceup cards to each player, three faceup cards can be dealt in the center of gaming table 10, with each player wagering on the same three cards. In this variation of the game, it is not necessary that each player make the same wagers. Thus, one player could wager that the number values of the three cards add up to an odd number, while another player wagers that they add up to an even number. Likewise, one player could wager that two of the three cards are red, while another player wagers that two of the three cards are black. It is not necessary that all players wager as to the same characteristic of the cards. Thus, one player might wager that the number values of the cards add up to an odd number and that the cards will include an eight of hearts. Another player might wager that the number values of the cards add up to an odd number and that at least one of the cards will be a four. A third player could wager that the number values of the cards add up to an even number and that at least one of the cards will be a diamond. Any possible combination of the several types of wagers that can be made might be placed on the same three cards.

In another variation, each player is dealt three face up cards, but a different wager is made as to a characteristic of each of the three cards. Thus, each player might wager as to whether the first card to be dealt to such player is odd or even, as to whether the second card to be dealt to the player is red or black, and as to any of the other possible characteristics with respect to the third card to be dealt to the player.

In a further variation, each player is dealt a single face up card and is able to wager as to whether that card is odd or even, whether the card is red or black, the number of the card, the suit of the card, and the specific card, with respect to that one card.

In yet another variation of the game, each player is dealt three face up cards, and the dealer is also dealt three face up cards. Each player places a wager as to his or her own three game cards, and the dealer places the same wager as to the dealer's three game cards. Thus, if the player wagers that the number values of his or her cards add up to an odd number, then the dealer wagers that the number values of the dealer's cards also add up to an odd number. If the player's cards add up to an odd number and the dealer's cards add up to an even number, then the player wins the wager. If the player's cards add up to an even number and the dealer's cards add up to an odd number, then the player loses the wager. If both the player's cards and the dealer's cards add up to odd numbers, or if both the player's cards and the dealer's cards add up to even numbers, then the player neither wins nor loses, but retains the amount of the wager. This same type of wager can be made as to whether the cards are red or black. While the same wagers could also be made as to other characteristics of the cards, this is likely to produce a majority of hands in which neither the player's cards nor the dealer's cards have the characteristic as to which the wager is placed, with the result that such wagers would be neither won nor lost by the player.

Figure 4:
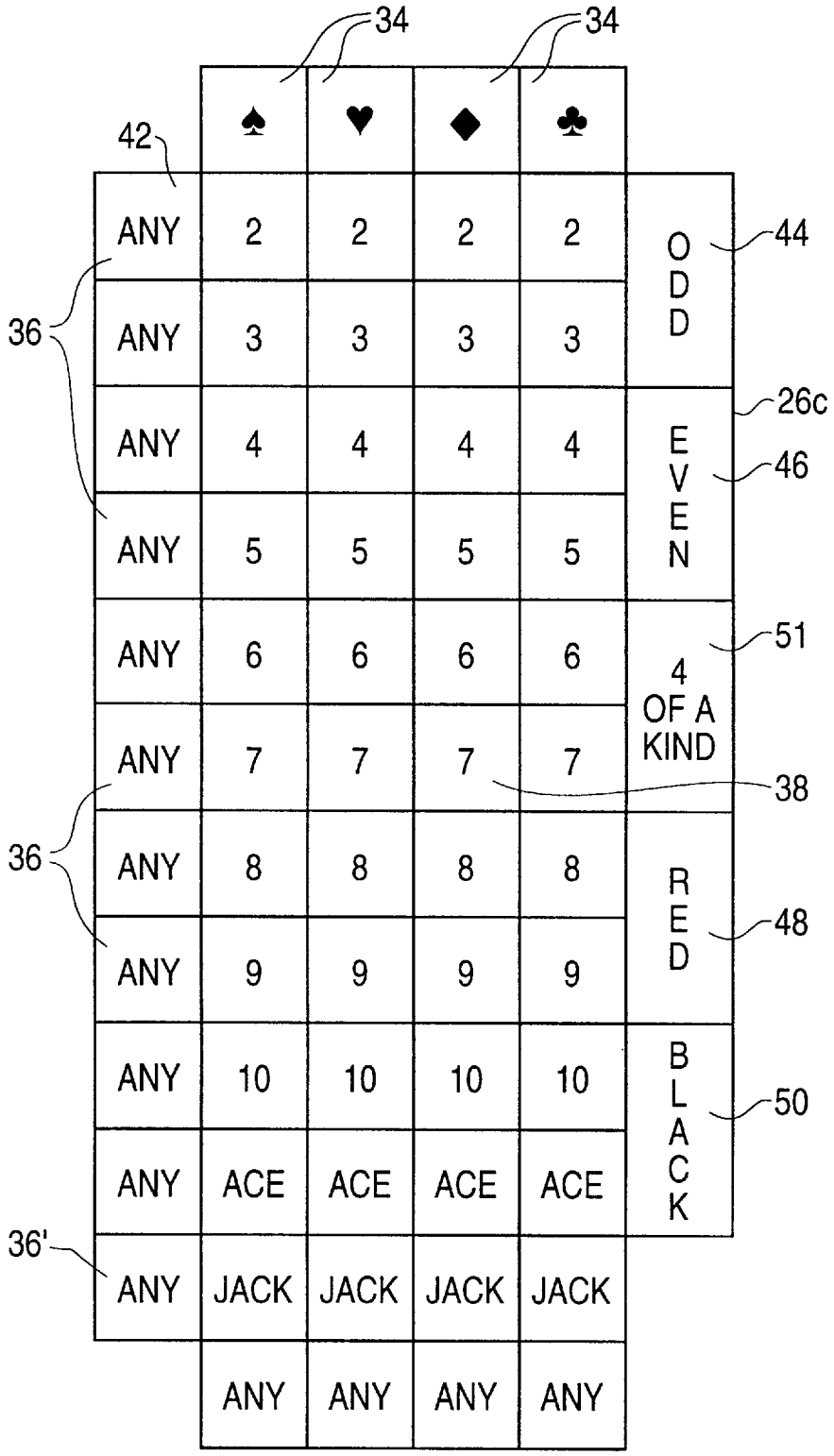
FIG. 4 is a plan view of a wagering area suitable for incorporation into the wagering tables of FIGS. 1 and 2.

FIG. 4 depicts another form of a wagering area 26*c* suitable for playing another embodiment of a wagering game in accordance with the present invention utilizing a deck of game cards made up of several decks of playing cards, such as six decks, from which all kings and queens have been removed, and if desired jokers added. Wagering area 26*c* differs from wagering area 26 of FIG. 1 by including a row 36' of wagering spaces for jacks. In this embodiment of the game, the jacks have a card value of zero, and when any player is dealt three cards that include a single jack, then that player loses the odd/even wager and any other wager that the player has placed on his or her own hand. However, if a player is dealt three cards that include two or three jacks, then that player wins a multiple of his or her odd/even wager, for example winning five times the wager for a three-card hand that includes two jacks, and winning one-hundred times the wager for a three-card hand that includes three jacks.

In addition, if the dealer's card is a jack, then the outcome of wagers placed on the dealer's card is altered. For example, if a player has made a red/black wager on the dealer's card and the dealer's card is a jack, then if that jack is the same color as the player has wagered, the wager is considered a "push," and the amount of the wager is returned to the player, but if the jack is the other color, then the player loses the wager. Likewise, if a player has placed a wager that the dealer's card is a particular suit and the card is the jack of that suit, then the wager is a push, but if it is a jack of any other suit, then the player loses the wager.

Further, a player can wager that the dealer's card is a jack by placing a wagering token on the ANY wagering space of row 36' in wagering area 26*c*. Then, if the dealer's card is a jack, the player wins the wager. Likewise, a player can wager that the dealer's card is the jack of a particular suit by placing a wagering token on the wagering space within row 36' for the desired suit and will win the wager if the dealer's card is that particular jack.

In this form of the wagering game, the odds paid for winning are, of course, affected by the fact that player loses his or her odd/even wager when that player receives a jack and that most otherwise winning wagers on the dealer's card are a push when the dealer's card is a jack. Winning wagers can be paid in accordance with the following payout schedule, which is given only as an example:

| Player's Hand | Payout | Dealer's Card | Payout |
|---|---|---|---|
| Odd/Even | 1:1 | Odd/Even | 1:1 |
| One Jack | Lose | Red/Black | 1:1 |
| Two Jacks | 5:1 | Specific Suit | 3:1 |
| Three Jacks | 100:1 | Specific Number | 9:1 |
| Four of a Kind Jackpot | 75:1 | | |

Figure 5:
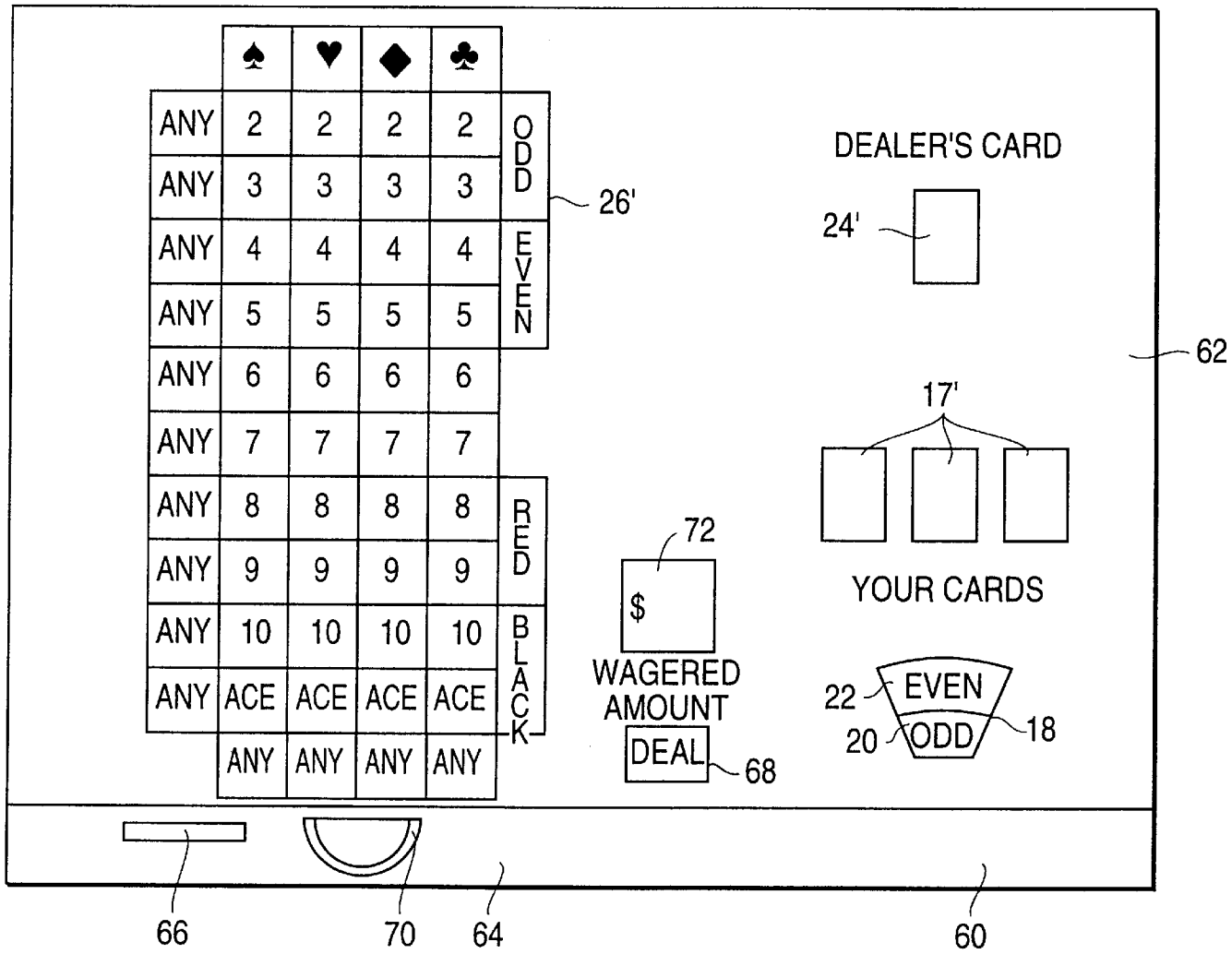
FIG. 5 is a plan view of a video screen display for an electronic gaming table for playing a wagering game in accordance with the present invention.

In addition to be playable at a gaming table such as gaming tables 10, 10*b* or 10*c*, a wagering game in accordance with the present invention can be provided on an electronic game machine having a video screen, such as a touch screen. FIG. 5 depicts such an electronic gaming table 60, including a touch screen 62 and a control area 64. Touch screen 62 includes a wagering area 26' which is depicted in FIG. 5 as having the same layout as wagering area 26 of FIG. 1. Touch screen 62 also has a wagering area 18 with wagering locations 20 and 22 to permit the player to place an odd/even wager on the three game cards to be dealt to the player. In addition, touch screen 62 has a dealer card indication area 24' and three player card indication areas 17' to indicate the three cards dealt to the player. Card areas 17' and 24' are not responsive to touch. Further, touch screen has a "deal" space 68 to permit a player to cause the electronic game table to deal three cards face up to card areas 17' and a card face down to card area 24' and to turn the face down card over.

The player control area 64 includes a token slot 66 to permit a player to insert a token or coin to activate the electronic game table and a token return 70 through which the electronic gaming table 60 awards tokens to a winning player. A "wagered amount" display 72 is provided on touch screen 62 to indicate the total amount the player has wagered on the game hand by inserting tokens through token slot 66. A player who has activated the electronic game machine by inserting a token in slot 64 can indicate a desired wager by touching the associated space on wagering area 26' and can cause the machine to deal a game hand by touching space 68.

The wagering area 26*b* of FIG. 3 or 26*c* of FIG. 4 or any other wagering area could be utilized in place of wagering area 26' on touch screen 62 so long as the wagering area provides the opportunity for the player to indicate the desired wagers.

It is thus seen that the present invention provides a wagering game offering fast play, multiple opportunities for the players to place numerous wagers of different types, and rapid determination of winners, while competing only against the house and not against other players. Although the invention has been described with reference to preferred embodiments, numerous variations and alterations could be made, and still the result would come within the scope of the invention.

I claim:

1. A method of playing a wagering game with a number of players and a dealer, utilizing a deck of game cards formed by combining a plurality of standard decks of playing cards from which all kings and queens have been removed so as to leave only numbered cards, jacks, and aces, with the numbered cards having a number value equal to their number, with jacks having a number value of zero, and with the aces having a number value of eleven, said method comprising the steps of:

(a) having each player place a first wager identifying a type of a game hand selected from a group of game hands including:

(i) odd, wherein "odd" is defined as a game hand in which the total number value of the game cards making up the game hand is an odd number; and (ii) even, wherein "even" is defined as a game hand in which the total number value of the game cards making up the game hand is an even number;

(b) dealing face up to each player a game hand comprising a plurality of game cards from the deck;

(c) identifying as a first wager loser any player who in step (b) was dealt a single jack;

(d) identifying as a first wager winner any player who in step (c) was not a loser and who in step (a) placed a first wager identifying a game hand of the type dealt to that player, and (e) awarding to any player identified as a first wager winner an award based on the wager placed by such player in step (a) and the odds of the game hand of the type identified by the first wager of such player being dealt to such player in step (b).

2. A method as claimed in claim 1, wherein in step (a), the group of game hands further includes:

(iii) red, wherein "red" is defined as a game hand in which the majority of the game cards making up the game hand are red in color; and (iv) black, wherein "black" is defined as a game hand in which the majority of the game cards making up the game hand are black in color.

3. A method as claimed in claim 1, wherein in step (a), the group of game hands further includes:

(iii) particular number, wherein "particular number" is defined as a game hand including a game card of a preselected number.

4. A method as claimed in claim 1, wherein in step (a), the group of game hands further includes:

(iii) particular suit, wherein "particular suit" is defined as a game hand including a game card of a preselected suit.

5. A method as claimed in claim 1, wherein in step (a), the group of game hands further includes:

(iii) particular game card, wherein "particular game card" is defined as a game hand including a preselected game card.

6. A method as claimed in claim 1, wherein in step (a), the group of game hands further includes:

(iii) all of an identical number, wherein "all of an identical number" is defined as a game hand in which all of the game cards are of an identical number.

7. A method as claimed in claim 1, wherein in step (a), the group of game hands further includes:

(iii) all of an identical particular number, wherein "all of an identical particular number" is defined as a game hand in which all of the game cards are of an identical preselected number.

8. A method as claimed in claim 1, wherein in step (a), the group of game hands further includes:

(iii) all of an identical suit, wherein "all of an identical suit" is defined as a game hand in which all of the game cards are of an identical suit.

9. A method as claimed in claim 1, wherein in step (a), the group of game hands further includes:

(iii) all of an identical particular suit, wherein "all of an identical particular suit" is defined as a game hand in which all of the game cards are of an identical preselected suit.

10. A method as claimed in claim 1, wherein in step (a), the group of game hands further includes:

(iii) all of particular numbers, wherein "all of particular numbers" is defined as a game hand in which all of the game cards are of preselected numbers.

11. A method as claimed in claim 1, wherein in step (a), the group of game hands further includes:

(iii) all of particular suits, wherein "all of particular suits" is defined as a game hand in which all of the game cards are of preselected suits.

12. A method as claimed in claim 1, wherein in step (a), the group of game hands further includes:

(iii) all of particular cards, wherein "all of particular cards" is defined as a game hand in which all of the game cards are preselected cards.

13. A method as claimed in claim 1, wherein in step (a), the group of game hands further includes:

(iii) all of identical cards, wherein "all of identical cards" is defined as a game hand in which all of the game cards are identical.

14. A method as claimed in claim 1, wherein in step (a), the group of game hands further includes:

(iii) all of identical particular cards, wherein "all of identical particular cards" is defined as a game hand in which all of the game cards are an identical preselected card.

15. A method as claimed in claim 1, wherein in step (a), the group of game hands further includes:

(iii) particular value, wherein "particular value" is defined as a game hand in which the total number value of the game cards making up the game hand is at least a preselected value.

16. A method as claimed in claim 15, wherein the preselected value is 21.

17. A method as claimed in claim 1, further comprising before step (c) identifying as a multiple winner any player who in step (a) was dealt more than one jack; and wherein in step (c) only players who have not been identified as multiple winners may be identified as first wager losers, and step (e) includes awarding to any player identified as a multiple winner an award based on the wager placed by such player in step (a).

18. A method as claimed in claim 1, wherein:

(1) step (a) includes permitting each player to place a second wager identifying a characteristic of a game card;

(2) step (b) comprises (i) dealing at least one game card from the deck face up to each player; (ii) dealing one game card face down from the deck to the dealer; and (iii) dealing at least one game card face up from the deck to each player; and (3) step (d) includes turning over the game card dealt to the dealer; and when the game card dealt to the dealer is a jack, identifying as a second wager push any second wager placed in step (a) which identifies a characteristic of the jack, and returning all push wagers to the respective players who placed such wagers; and when the game card dealt to the dealer is not a jack, identifying as a second wager winner any player who in step (a) placed a second wager identifying a characteristic of the game card dealt to the dealer.

19. A method as claimed in claim 18, wherein the characteristic is selected from a group of characteristics including:

(i) odd, wherein "odd" is defined as a game card having an odd number; and (ii) even, wherein "even" is defined as a game card having an even number.

20. A method as claimed in claim 18, wherein the characteristic is selected from a group of characteristics including:

(i) red, wherein "red" is defined as a game card which is red in color; and (ii) black, wherein "black" is defined as a game card which is black in color.

21. A method as claimed in claim 18, wherein the characteristic identifies a game card of a particular number.

22. A method as claimed in claim 18, wherein the characteristic identifies a game card of a particular suit.

23. A method as claimed in claim 18, wherein the characteristic identifies a particular game card as the dealer's game card.

24. A method as claimed in claim 1, wherein:

(1) in step (a), the group of game hands further includes (iii) all of an identical number;

(2) step (b) comprises (i) dealing at least one game card from the deck face up to each player; (ii) dealing one game card face down from the deck to the dealer; (iii) dealing at least one game card face up from the deck to each player; and (iv) turning over the game card dealt to the dealer;

(3) "all of an identical number" is defined as a game hand in which all of the dealt game cards have an identical number; and (4) the game hand for each player comprises the game cards dealt to that player and the game card dealt to the dealer.

25. A method as claimed in claim 24, wherein "all of an identical number" is further defined as a game hand in which all of the dealt game cards are of different suits.

26. A method as claimed in claim 24, wherein "all of an identical number" is further defined as a game hand in which all of the dealt game cards are of the same suit.

27. A method as claimed in claim 1, wherein:

(1) in step (a), the group of game hands further includes (iii) all of an identical particular number;

(2) step (b) comprises (i) dealing at least one game card from the deck face up to each player; (ii) dealing one game card face down from the deck to the dealer; (iii) dealing at least one game card face up from the deck to each player, and (iv) turning over the game card dealt to the dealer;

(3) "all of an identical particular number" is defined as a game hand in which all of the dealt game cards have an identical preselected number; and (4) the game hand for each player comprises the game cards dealt to that player and the game card dealt to the dealer.

28. A method as claimed in claim 1, wherein the deck of game cards is formed by combining six standard decks of playing cards from which all of the kings and queens have been removed.

29. A method as claimed in claim 1, further comprising activating an electronic game machine, and wherein steps (b) and (c) are performed by the electronic game machine.

30. A method as claimed in claim 1, wherein step (b) comprises dealing three cards to each player.

31. A method of playing a wagering game with a number of players and a dealer, utilizing a deck of game cards formed by combining a plurality of standard decks of playing cards from which all kings and queens have been removed so as to leave only numbered cards, jacks, and aces, with the numbered cards having a numerical value equal to their number, with the jacks having a numerical value of zero, and with the aces having a numerical value of eleven, said method comprising the steps of:

(a) having each player place a first wager identifying a type of game hand selected from a group of game hands including:

(i) odd, wherein "odd" is defined as a game hand in which the total number value of the game cards making up the game hand is an odd number; and (ii) even, wherein "even" is defined as a game hand in which the total number value of the game cards making up the game hand is an even number;

(b) dealing face up a game hand comprising a plurality of game cards from the deck;

(c) if in step (b) a single jack was dealt, then identifying all the players as first wager losers;

(d) if in step (b) more than one jack was dealt, then identifying all the players as multiple winners;

(e) if in step (b) no jack was dealt, then identifying as a first wager winner any player who in step (a) placed a first wager identifying a game hand of the type dealt in step (b); and (f) awarding to any player identified as a multiple winner an award based on the wager placed by such player in step (a), and awarding to any player identified as a first wager winner an award based on the wager placed by such player in step (a) and the odds of a game hand of the type identified by the first wager of such player being dealt in step (b).

* * * * *